US007604093B2

(12) United States Patent
Bach

(10) Patent No.: US 7,604,093 B2
(45) Date of Patent: Oct. 20, 2009

(54) EXHAUST DIFFUSER FOR VEHICLE

(75) Inventor: Travis Bach, Morresboro, NC (US)

(73) Assignee: Daimler Trucks North America LLC, Portland, OR (US)

( * ) Notice: Subject to any disclaimer, the term of this patent is extended or adjusted under 35 U.S.C. 154(b) by 0 days.

(21) Appl. No.: 11/981,245

(22) Filed: Oct. 30, 2007

(65) Prior Publication Data

US 2008/0099276 A1 May 1, 2008

Related U.S. Application Data

(60) Provisional application No. 60/856,220, filed on Nov. 1, 2006.

(51) Int. Cl.

| | |
|---|---|
| ***F01N 7/08*** | (2006.01) |
| ***F01N 7/20*** | (2006.01) |
| ***F01B 31/16*** | (2006.01) |
| ***F01B 31/30*** | (2006.01) |
| *F01N 7/00* | (2006.01) |
| *F01B 31/00* | (2006.01) |

(52) U.S. Cl. ..... 181/228; 181/227; D12/194; 60/694

(58) Field of Classification Search ..... 181/228, 181/227, 238, 239, 259, 243, 260, 261; D12/194; 60/323, 359, 694, 695

See application file for complete search history.

(56) References Cited

U.S. PATENT DOCUMENTS

| | | | | | |
|---|---|---|---|---|---|
| 1,173,801 | A | * | 2/1916 | Hess | 239/289 |
| 1,521,047 | A | | 12/1924 | Reynolds | |
| D112,482 | S | * | 12/1938 | Koch | D12/194 |
| D133,788 | S | * | 9/1942 | Koch | D12/194 |
| D158,848 | S | * | 6/1950 | Follen | D12/194 |
| D162,112 | S | * | 2/1951 | Baker | D12/194 |
| D165,874 | S | * | 2/1952 | Russell | D12/194 |
| D165,986 | S | * | 2/1952 | Koonter | D12/194 |
| 2,693,863 | A | | 11/1954 | Walker | |
| D177,877 | S | * | 5/1956 | Sandler | D12/194 |
| 2,754,138 | A | | 7/1956 | Kramer | |
| D183,145 | S | * | 7/1958 | Russell | D12/194 |
| 2,864,406 | A | | 12/1958 | Schewel | |
| 2,865,169 | A | | 12/1958 | Hausmann | |
| 2,868,228 | A | * | 1/1959 | Russell | 239/505 |
| 2,868,229 | A | * | 1/1959 | Russell | 239/132.3 |
| 2,919,720 | A | * | 1/1960 | Nicholls | 239/517 |
| D189,573 | S | * | 1/1961 | Russell | D12/194 |
| 3,110,358 | A | | 11/1963 | Ludlow et al. | |
| 3,404,750 | A | * | 10/1968 | Powers et al. | 181/228 |
| 3,561,562 | A | * | 2/1971 | Ignoffo | 181/247 |
| 3,592,292 | A | | 7/1971 | Lavallee | |
| 3,752,260 | A | * | 8/1973 | Heath | 181/228 |
| 3,792,722 | A | * | 2/1974 | Harmon | 138/108 |
| 3,949,550 | A | | 4/1976 | Albrecht et al. | |
| 3,981,449 | A | | 9/1976 | Krey et al. | |

(Continued)

OTHER PUBLICATIONS

International Search Report from PCT/US06/32069.

*Primary Examiner*—Edgardo San Martin
(74) *Attorney, Agent, or Firm*—Klarquist Sparkman, LLP

(57) ABSTRACT

An exhaust diffuser is disclosed for coupling to an exhaust system of a vehicle that, when in one orientation, is designed to exhaust gasses laterally and downwardly from the exhaust diffuser.

20 Claims, 13 Drawing Sheets
(3 of 13 Drawing Sheet(s) Filed in Color)

U.S. PATENT DOCUMENTS

| | | | | |
|---|---|---|---|---|
| D247,360 | S | | 2/1978 | Hamaguchi et al. |
| 4,183,896 | A | | 1/1980 | Gordon |
| 4,310,067 | A | | 1/1982 | Thomson |
| 4,323,139 | A | * | 4/1982 | Baldwin ..... 181/263 |
| 4,390,079 | A | | 6/1983 | Brill |
| 4,504,238 | A | | 3/1985 | Neisen |
| 4,544,098 | A | | 10/1985 | Warburton |
| 4,742,961 | A | | 5/1988 | Starke |
| 5,058,703 | A | | 10/1991 | Ealba et al. |
| 5,265,408 | A | | 11/1993 | Sheoran et al. |
| 5,280,143 | A | | 1/1994 | Kakuta |
| D351,579 | S | | 10/1994 | Simpson |
| 5,466,900 | A | | 11/1995 | Knapp |
| 5,508,478 | A | | 4/1996 | Barry |
| 5,716,271 | A | * | 2/1998 | Paidosh ..... 454/359 |
| 5,881,554 | A | | 3/1999 | Novak et al. |
| 5,983,628 | A | | 11/1999 | Borroni-Bird et al. |
| 6,000,635 | A | | 12/1999 | Justice |
| 6,035,633 | A | | 3/2000 | Woods |
| 6,085,863 | A | * | 7/2000 | Shuen ..... 181/228 |
| 6,230,488 | B1 | | 5/2001 | Voss |
| D453,773 | S | * | 2/2002 | Garcia ..... D15/5 |
| D458,570 | S | | 6/2002 | Wang |
| 6,471,377 | B1 | | 10/2002 | Stegall |
| 6,588,545 | B1 | | 7/2003 | Lee |
| 6,595,318 | B2 | | 7/2003 | Ebinger et al. |
| 6,609,590 | B2 | | 8/2003 | Zelinski |
| 6,640,927 | B1 | | 11/2003 | Turner |
| 6,647,970 | B2 | | 11/2003 | Hankins |
| 6,663,269 | B1 | * | 12/2003 | Leu ..... 362/487 |
| 6,729,122 | B2 | | 5/2004 | Watanabe et al. |
| 6,800,004 | B1 | | 10/2004 | White et al. |
| 6,804,949 | B2 | | 10/2004 | Andrews et al. |
| 6,910,793 | B1 | * | 6/2005 | Shuen ..... 362/545 |
| 6,910,930 | B1 | | 6/2005 | Mitchell |
| 2004/0206573 | A1 | | 10/2004 | Hsu |
| 2007/0039318 | A1 | * | 2/2007 | Krajewski et al. ..... 60/317 |

* cited by examiner

EXHAUST DIFFUSER FOR VEHICLE

RELATED APPLICATION DATA

This application claims the benefit of U.S. provisional patent application No. 60/856,220, filed Nov. 1, 2006, entitled, "Exhaust Diffuser for Vehicle", by Travis Bach, which is hereby incorporated by reference.

FIELD

The invention is directed to, among other things, an exhaust diffuser for diffusing exhaust gas from the exhaust system of a vehicle.

BACKGROUND

The temperature of exhaust expunged from a tailpipe outlet at a certain distance away from the outlet must meet certain industry safety standards. Diesel vehicle engines that will soon be introduced will be configured to burn exhaust particulates resulting in hotter exhaust gasses. For example, some engines will be capable of producing exhaust gases at or above 1200° F. Known exhaust gas systems may not be able to sufficiently reduce the exhaust gas temperature to meet industry standards.

The exhaust diffuser disclosed herein diffuses, dilutes and disperses hot engine exhaust gas from the exhaust system of a vehicle. The diffuser is configured to accelerate the reduction of the temperature of the exhaust gas exiting the exhaust system such that the maximum temperature of the exhaust gas at specific distances away from the diffuser meets industry standards.

SUMMARY

In accordance with the disclosure, various embodiments of an exhaust diffuser for coupling to an exhaust system of a vehicle to diffuse exhaust gas from the exhaust system when the vehicle is operating are disclosed. Desirable forms of the exhaust gas diffuser can comprise a number of features, both alone and various novel sub-combinations and combinations with one another.

In accordance with the disclosure, an exhaust gas diffuser can comprise an exhaust gas inlet for coupling to a vehicle exhaust system to receive exhaust gas from the exhaust system. An exhaust diffusion section in gas flow communication with the exhaust gas inlet section defines a gas flow passageway to an exhaust gas outlet adjacent an exhaust deflector portion of the diffuser.

The exhaust gas outlet can comprise a slot, which can be approximately of a uniform width, with a portion of the slot being positioned along the bottom of the diffuser and portions of the slot being positioned at lower side portions of the diffuser. The diffuser promotes both lateral and downward flow of exhaust gases from the diffuser when the diffuser is in a first orientation, for example, with the diffuser body having a longitudinal axis that is generally horizontal.

The exhaust diffusion section can comprise side portions that at least in part diverge moving in a downstream direction away from the exhaust gas inlet so as to define a gas flow passageway that increases in cross-sectional dimension along at least a portion of the exhaust diffusion section in the downstream direction. For example, at least a portion of the exhaust diffusion section can be of an elongated ovular cross-section in a plane perpendicular to the downstream direction. As another example, the exhaust diffusion section can be of an elliptical cross section with a major axis that increases in dimension moving in a downstream direction along the length of the diffusion section, or at least along a portion of the length thereof, and with a minor axis that is approximately constant along the length of the diffusion section, or at least along a portion of the length thereof.

In one form, the diffuser can have a generally rectangular shaped side profile and a generally triangular shaped footprint.

The exhaust deflector portion can comprise an exhaust deflector such as an exhaust deflection plate, angled in a downward and downstream direction when the exhaust diffuser is in a first orientation. The exhaust deflection portion can comprise a planar exhaust deflection surface that is at an obtuse angle relative to a horizontal plane parallel to the longitudinal axis of the exhaust diffusion section when the exhaust diffuser is in a first orientation. As a specific example, the obtuse angle can be from about 100 degrees to about 170 degrees with an obtuse of about 135 degrees being a desirable example.

These and other novel features of an exhaust gas diffuser will become more apparent with reference to the following description.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1A:
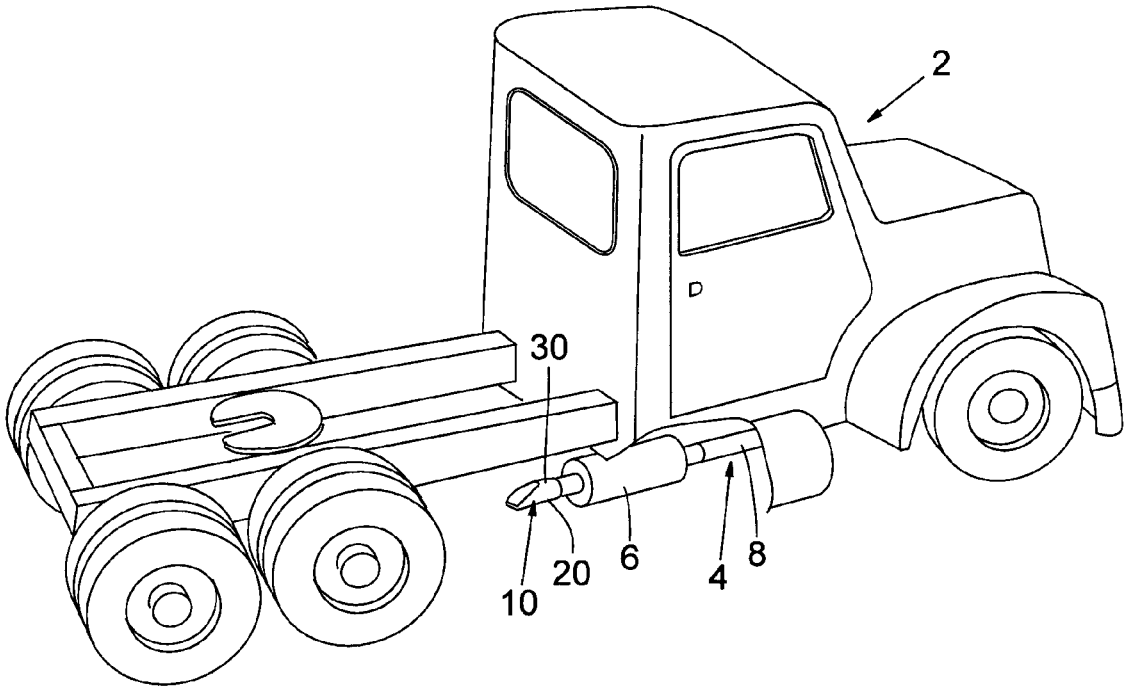
FIG. 1A is a perspective view of a truck illustrating one embodiment an exhaust gas diffuser.
Figure 1B:
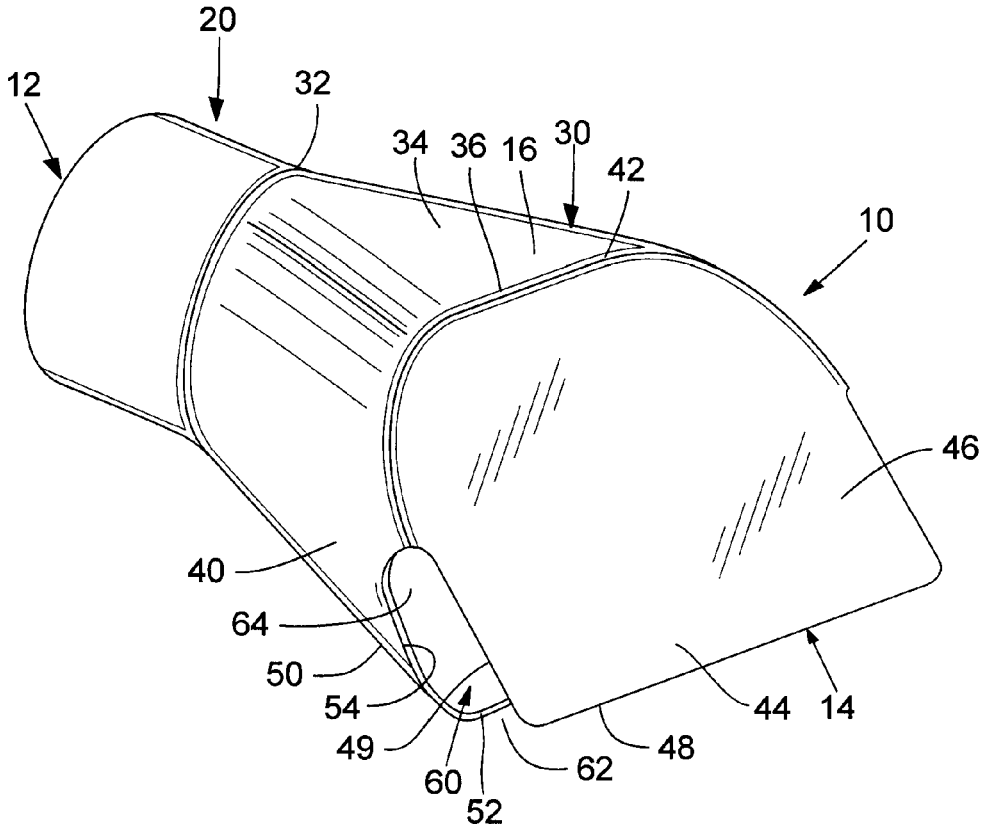
FIG. 1B is a perspective view of an exemplary embodiment of an exhaust gas diffuser.
Figure 1C:
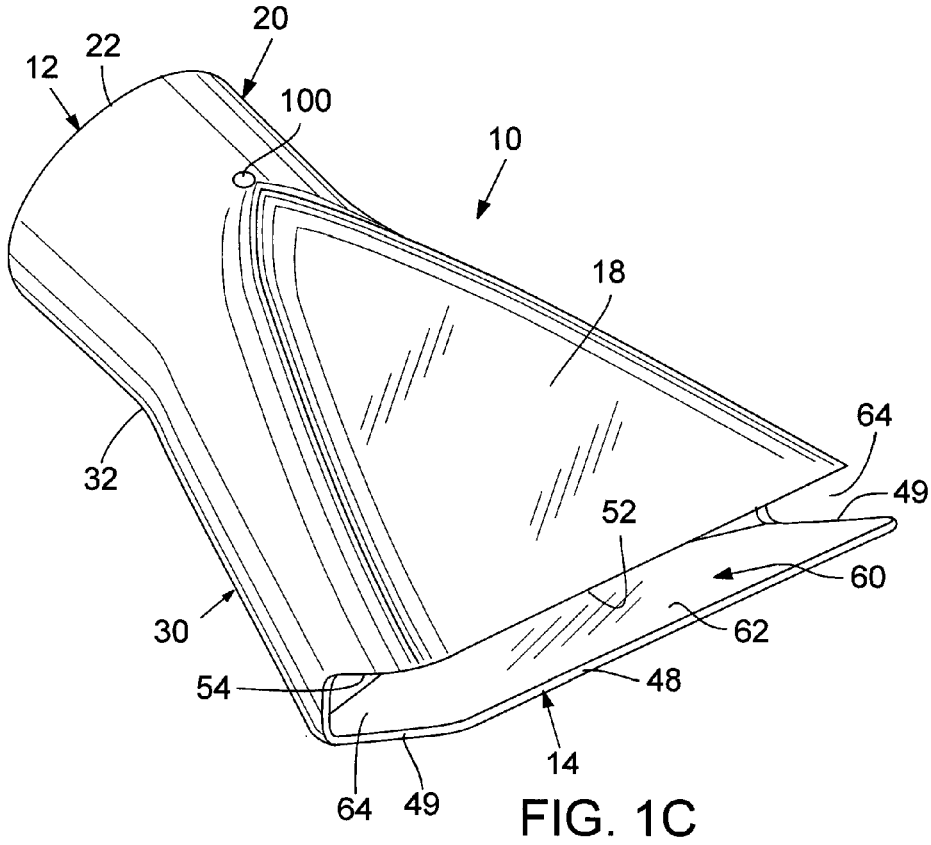
FIG. 1C is a bottom perspective view of another embodiment of an exhaust gas diffuser, of the form shown in FIG. 4A in a non-horizontal orientation.

As shown in FIG. 1B, an exhaust diffuser 10 generally comprises a diffuser body that can comprise an exhaust inlet section 20 and nozzle section 30 located intermediate first and second ends 12, 14 of the diffuser. The exhaust diffuser is desirably of a one-piece seamless construction. However, plural diffuser portions may alternatively be interconnected to form the diffuser.

Referring specifically to FIG. 1A, the exhaust diffuser 10 is coupled to an exhaust system 4 of a vehicle 2 by coupling, such as, for example, welding, adhering, or fastening, the inlet section 20, to a component of the vehicle exhaust system, for example, an after-treatment device such as a muffler 6 or tailpipe. The term coupling includes both direct mounting or connection as well as indirect connection through one or more additional elements. The muffler 6 is coupled to an exhaust conduit, such as exhaust pipe 8, which couples the muffler 6 and the vehicle's engine (not shown). Exhaust from the vehicle's engine flows through the conduit 8, muffler 6, and diffuser 10, and is then dispersed from the diffuser into the atmosphere.

In certain implementations, the inlet section 20 includes a generally tubular structure defining a passageway of a suitable shape, such as a cylindrical passageway having a circular cross-section, through which exhaust may flow. For example, the inlet section 20 includes an exhaust inlet opening 22 that is in exhaust receiving communication with the exhaust system of a vehicle, such as exhaust system 4 of vehicle 2, when the diffuser 10 is coupled to the exhaust system. In some implementations, the exhaust inlet section 20 can include a flanged portion (not shown) or other portion or attachment proximate the first end inlet opening 22 for facilitating coupling the diffuser 10 to the exhaust system of a vehicle.

As shown, the nozzle section 30 can be seamlessly connected to the inlet section 20 at a first end portion 32 and in exhaust receiving communication with the inlet section. The nozzle section 30 at the first end portion 32 can define a passageway, such as a passageway having a generally cylindrical shape with a generally circular cross-section, that is approximately coextensive with the cross-section of the passageway of the inlet section 20. As used herein, coextensive generally means in close proximity to or sharing a general boundary, edge, or space. As used herein, coextensive can also mean adjacent or adjoining, but is not limited to direct contact.

Figure 2:
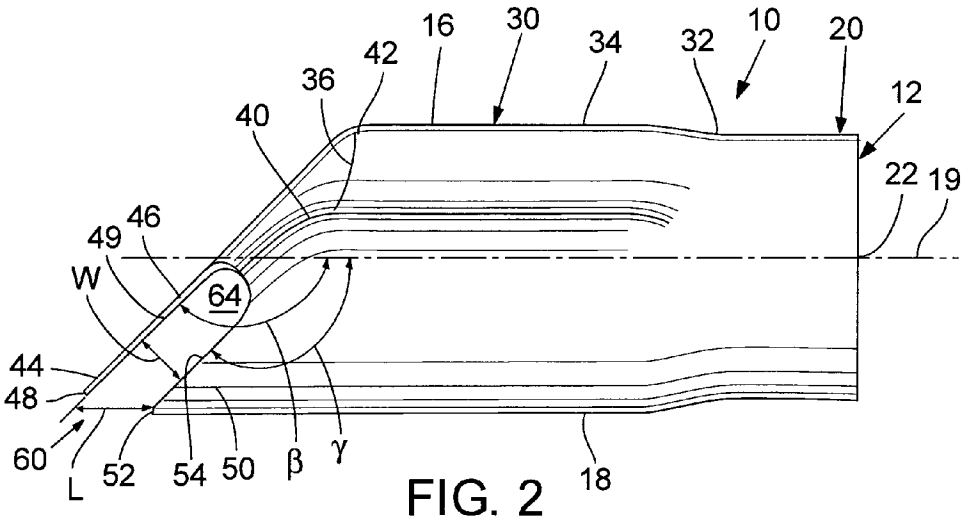
FIG. 2 is a side view of an exhaust gas diffuser of the form shown in FIG. 1B.
Figure 3:
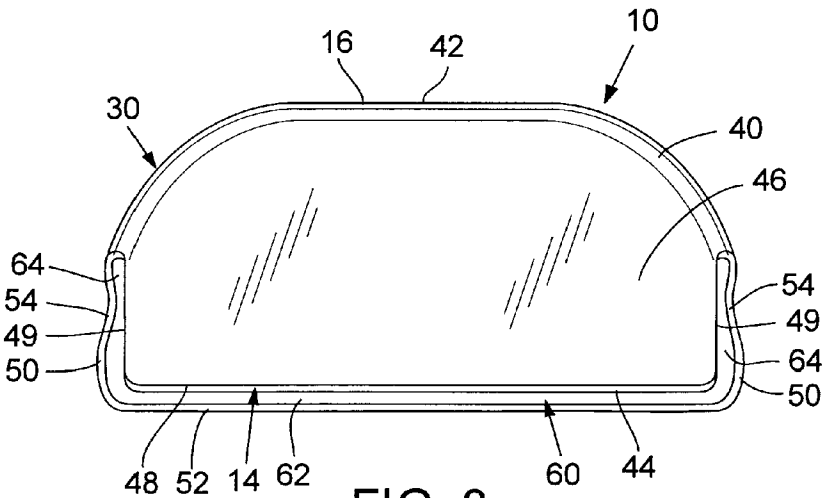
FIG. 3 is an end view of an exhaust gas diffuser of the form shown in FIG. 1B.

The nozzle section 30 comprises an exhaust diffusion section 34 coupled to and extending from the first end portion 32. The diffusion section 34 defines a passageway with a diverging sidewall moving in an exhaust flow, or downstream, direction, i.e., from the first end 12 of the diffuser 10 toward the second end 14. In other words, the diffusion section passageway desirably expands such that the area of the passageway increases along at least a portion of its axial length when moving in the downstream direction. In certain implementations, the diffusion section passageway has a generally elongate ovular or elliptical cross-section relative to a plane perpendicular to the axial length of the passageway. The elliptical diffusion section passageway can have a major axis that increases along the length of the diffusion section and a minor axis that remains generally (e.g. approximately) the same long the length of the diffusion section. For example, in some implementations, the exhaust diffusion section 34 can have a generally or approximately triangular-shaped footprint when viewed from above (see FIG. 4) and a generally or approximately rectangular-shaped side profile (see FIG. 2).

The nozzle section 30 also comprises an exhaust deflection section 40 coupled to and extending from a second end portion 36 of the diffusion section 34. In specific implementations, the deflection section 40 can form a seamless transition with the diffusion section 34. The deflection section 40 includes a first end portion 42 coextensive with the second end 36 of the diffusion section 40 and a second end portion 44 that can be coextensive with the second end 14 of the diffuser 10.

The exhaust deflection section 40 comprises an exhaust deflector, such as a deflector plate 46, that extends downwardly from a proximal end portion at a top surface 16 of the nozzle section 30 proximate the first end portion 42 of the deflection section to the second or distal end portion 44 of the deflection section. In other words, the deflector plate 46 extends in the exhaust flow direction at an angle of β (FIG. 2) with respect to a central axis 19 of the diffuser 10, e.g., a longitudinal axis that is concentric with the diffuser inlet section 20 (see FIG. 2). In some implementations, the angle θ can be between approximately 90° and approximately 180°. In more specific implementations, the angle β is between approximately 100° and 170°, e.g., 135°. The deflector plate 46 includes a distal or lower edge 48 that can be coextensive with the second ends 14, 44 of the diffuser 10 and deflection section 40, respectively, and side edges 49 that can extend approximately transversely from the bottom edge. In certain implementations, the deflector plate 46 can be substantially flat, minimally curved, or have minor surface undulations. In one desirable form, the deflector plate 46 has a flat or planar interior exhaust gas deflection surface.

The exhaust deflection section 40 can include a lip portion 50 extending in the exhaust flow direction from a bottom surface 18 of the nozzle section 30 to a lower edge 52. The lower edge 52 can be spaced-apart a predetermined distance, such as L, from the lower edge 48 of the deflector plate 46 and can extend parallel to the second end portion 44 of the deflection section 40. The lip portion 50 can include upper edges 54 extending in the upstream direction upwardly, such as at an angle γ with respect to the central axis 19, from the lower edge 52 to a location intermediate the top and bottom surfaces 16, 18 of the diffuser 10. In some implementations, the angle γ can be the same as or approximately equal to angle β such that he upper edges 54 extend approximately parallel to the deflector plate 46 and spaced-apart a distance, such as distance W, from each other. Although this can be varied, as a specific example W can be about 20 mm. Most desirably the width W is substantially or approximately constant and the width of the lower portion of the slot and at the sides of the diffuser is desirably the same.

The nozzle section 30 comprises an exhaust outlet opening 60 defined between the deflector plate 46 and the lip portion 50. The outlet opening 60 includes a rear portion 62 defined between the lower edges 48, 52 of the deflector plate 46 and lip portion 50, respectively, and two side portions 64 defined between the side edges 49 of the deflector plate and upper edges 54 of the lip portion. In certain implementations, the exhaust outlet opening 60 can be defined as an elongate slot extending along the rear edge 14 of the diffuser 10, and upwardly and forwardly along the sides of the diffuser.

The exhaust outlet opening 60 is configured to produce a wide multi-directional dispersion of exhaust gas from the diffuser 10. More specifically, the described features of the nozzle section 30, e.g., the diffusion section 34, deflector plate 46, and exhaust opening 60, facilitate a substantial portion of exhaust to be expelled laterally from the exhaust outlet opening 60. In some embodiments, a major portion (e.g., more than one-third) of the exhaust gases is dispersed laterally with substantially all of the remainder of the exhaust gas desirably being dispersed downwardly when the diffuser is in the orientation depicted in FIG. 1A.

The diffusion or expansion of exhaust gas in the exhaust diffusion section and lateral dispersion of exhaust gas facilitated by the diffuser described herein promotes rapid decentralization of the exhaust gas exiting the diffuser, thus resulting is a quicker reduction of the temperature of dispersed exhaust at locations away from the diffuser than conventional tailpipe configurations.

Figure 2A:
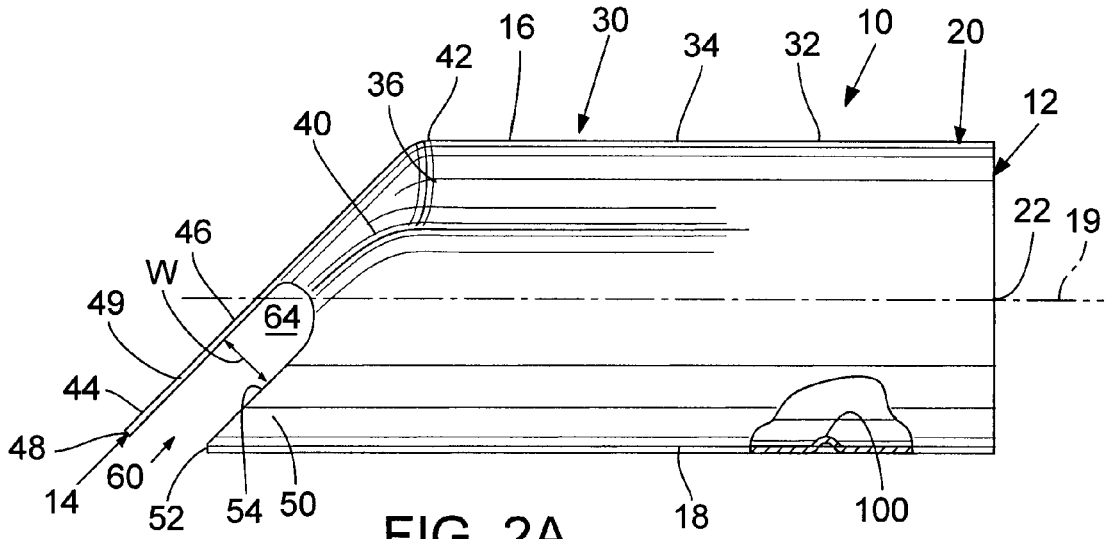
FIG. 2A is a side view of an embodiment of an exhaust gas diffuser of the form shown in FIGS. 4A and 4B.
Figure 4C:
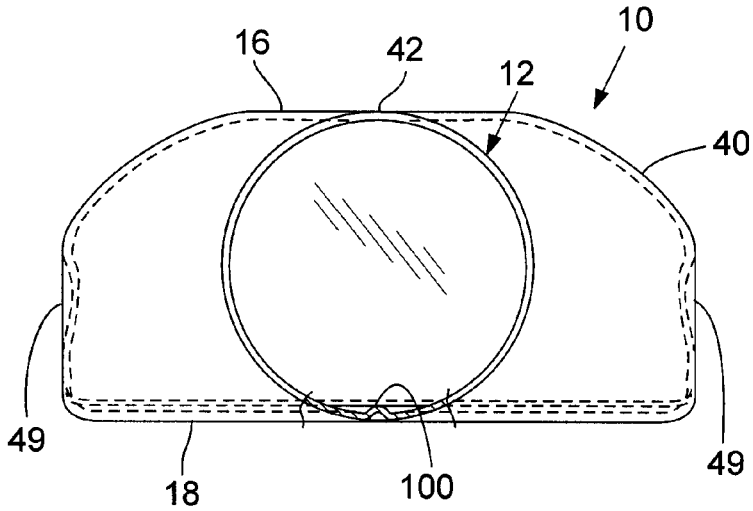
FIG. 4C is an end view, looking from the inlet gas exhaust gas inlet end of the exhaust gas diffuser of FIG. 4A.
Figure 4:
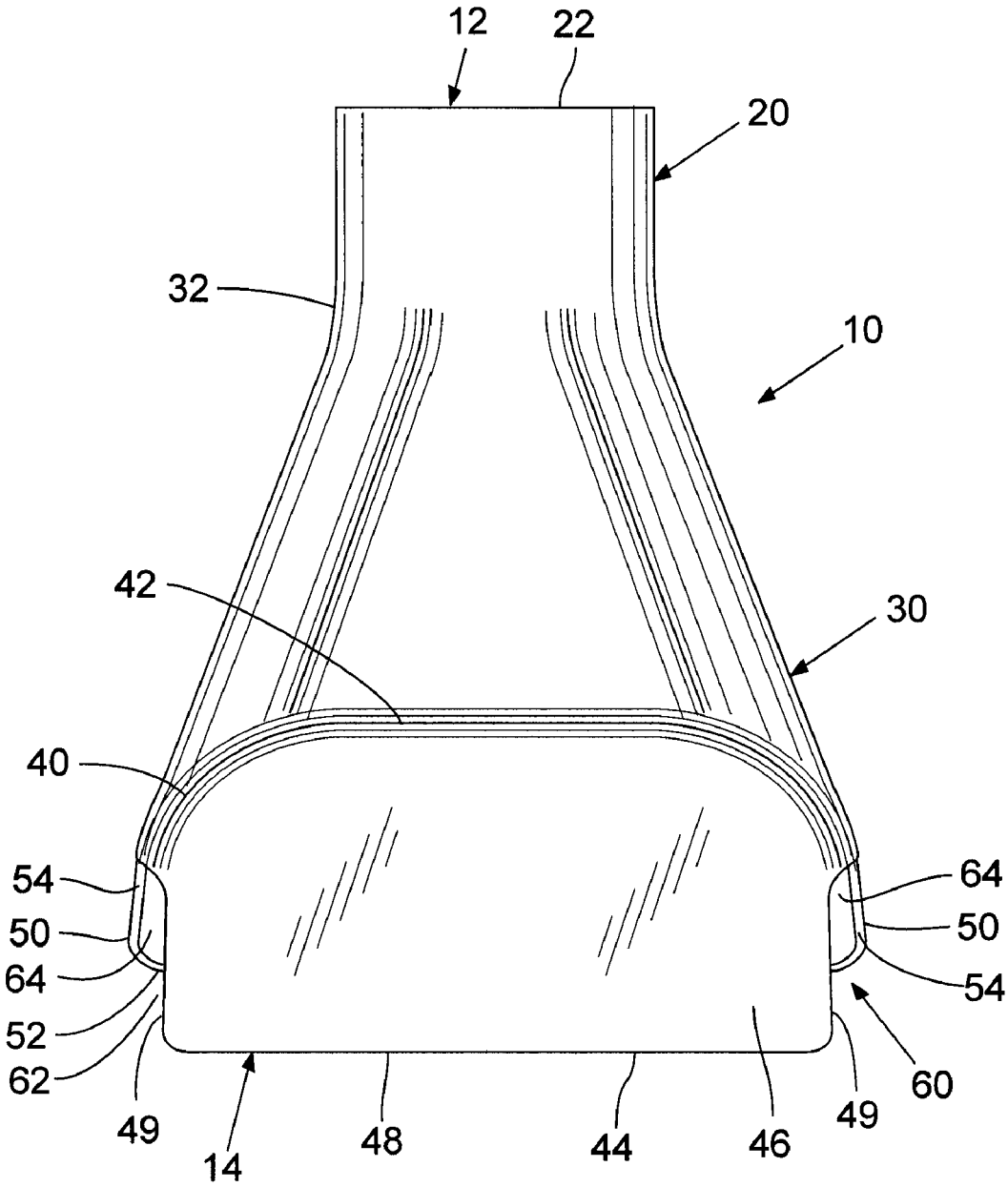
FIG. 4 is a top view of an exhaust gas diffuser of the form shown in FIG. 1B.
Figures 4A, 4B:
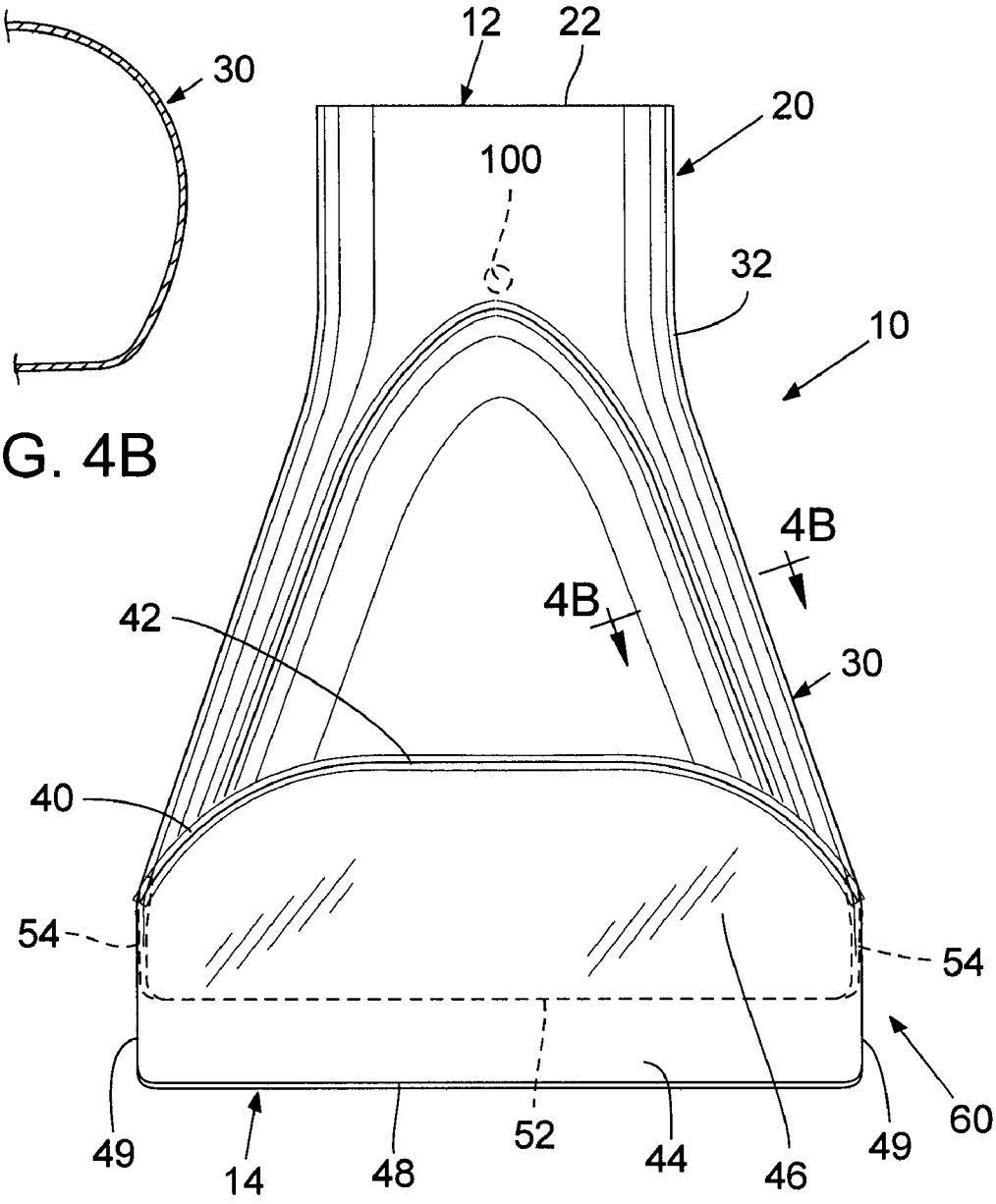
FIG. 4A is a top view of an exemplary alternative embodiment of an exhaust gas diffuser.
FIG. 4B is a sectional view of a portion of the exhaust gas diffuser of FIG. 4A taken along the lines B-B of FIG. 4A.

FIGS. 2A, 4A, 4B, 4C and IC illustrate an alternative embodiment of an exhaust gas diffuser. Numbers in common with the embodiments of FIGS. 1B, 2, 3 and 4 have been retained in this alternative embodiment. In the embodiment of FIGS. 4A through 4C, the inlet portion 20 can be designed to receive an exhaust tailpipe inserted into inlet opening 22. A stop, such as a projection punched or otherwise formed in inlet section 20, extends upwardly into the inlet (FIG. 4C) to limit the extent of insertion of an exhaust tailpipe into the exhaust diffuser. In the embodiment of FIG. 2A, the distal edge 48 of deflector plate 46 is shown slightly above the bottom 18 of the diffuser body, such as about 5 mm above the bottom edge. Desirably the deflector plate is sized and positioned to direct substantially all of the exhaust gasses in either downward or laterally outward directions when the diffuser is oriented as shown in FIG. 2A.

Simulated Test Results

Figure 5:
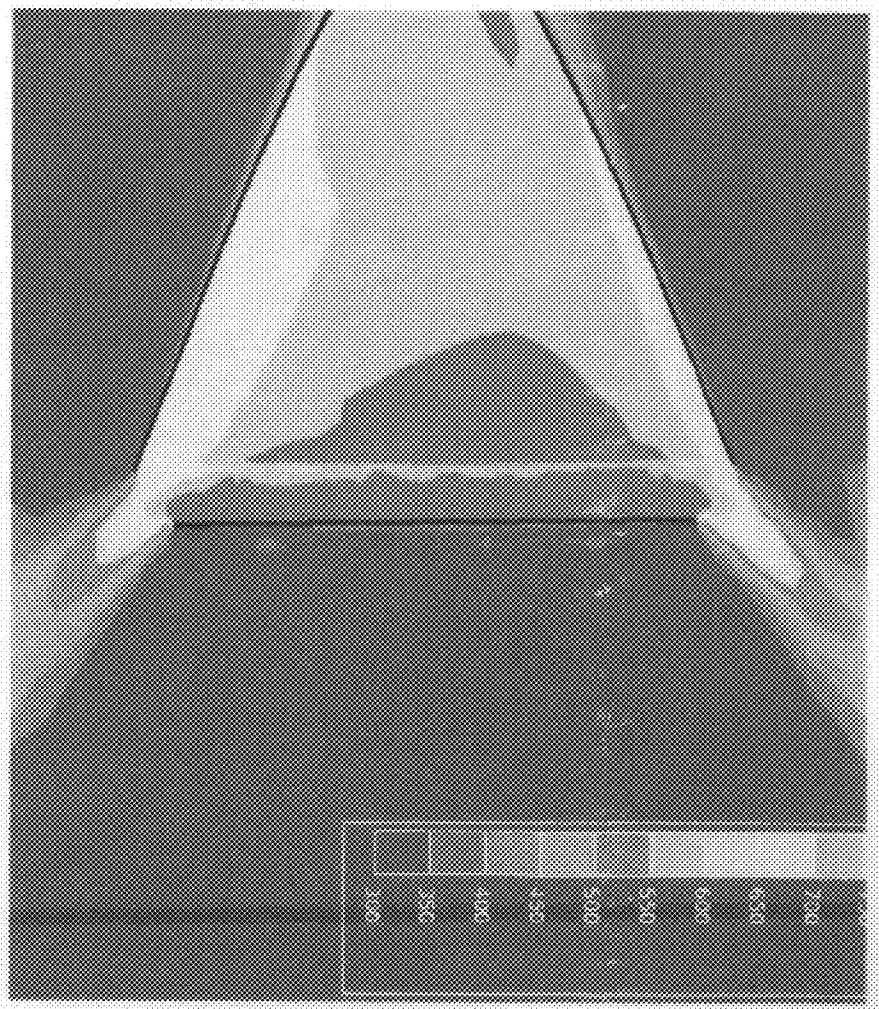
FIGS. 5, 6 and 7 are color drawings illustrating simulated exhaust gas temperatures at various locations.
Figure 5A:
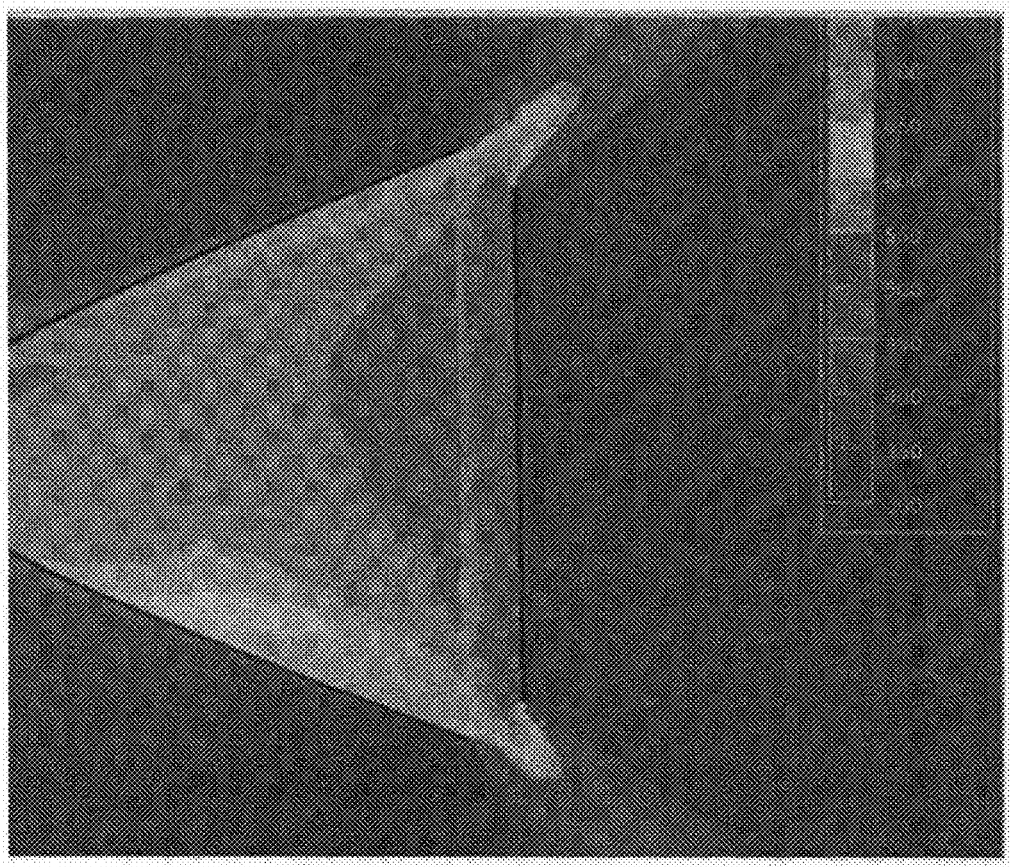
FIGS. 5A, 6A and 7A are graytone drawings corresponding respectively to FIGS. 5, 6 and 7.
Figure 6:
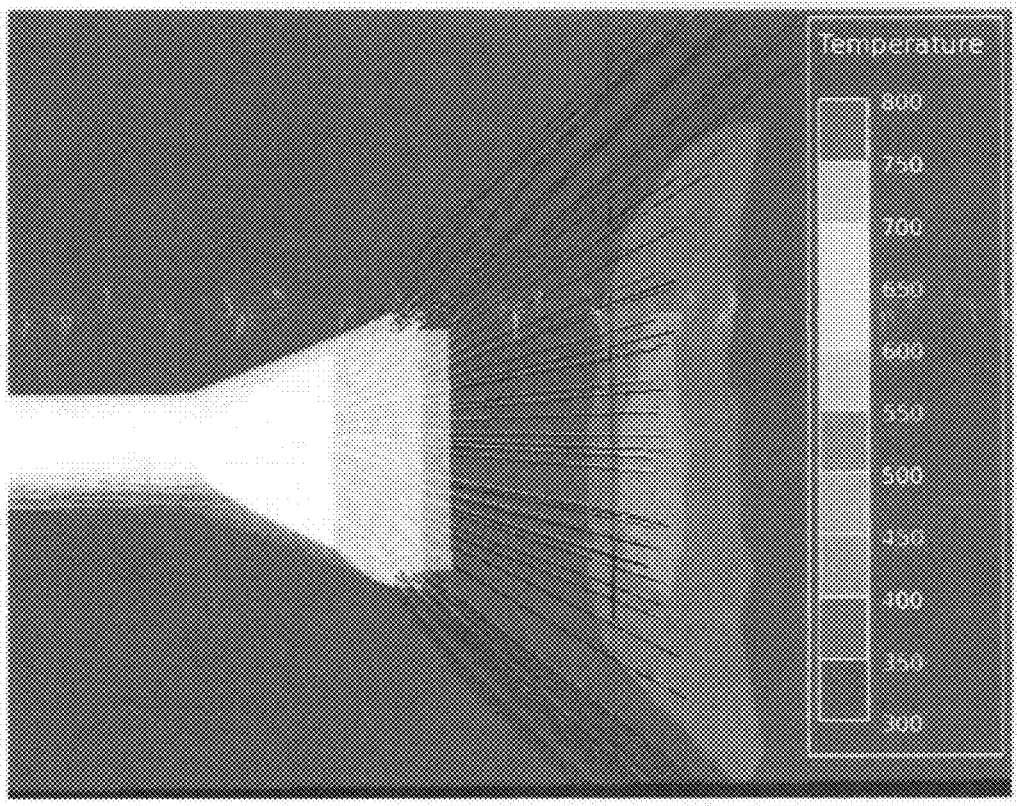
Figure 6A:
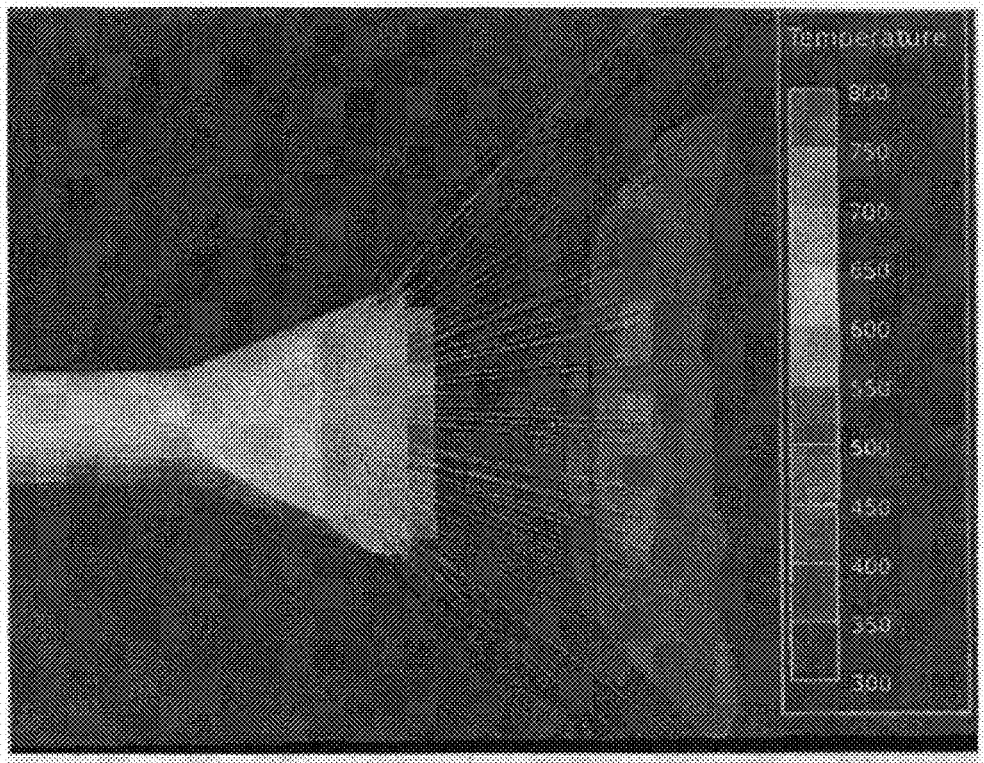
Figure 7:
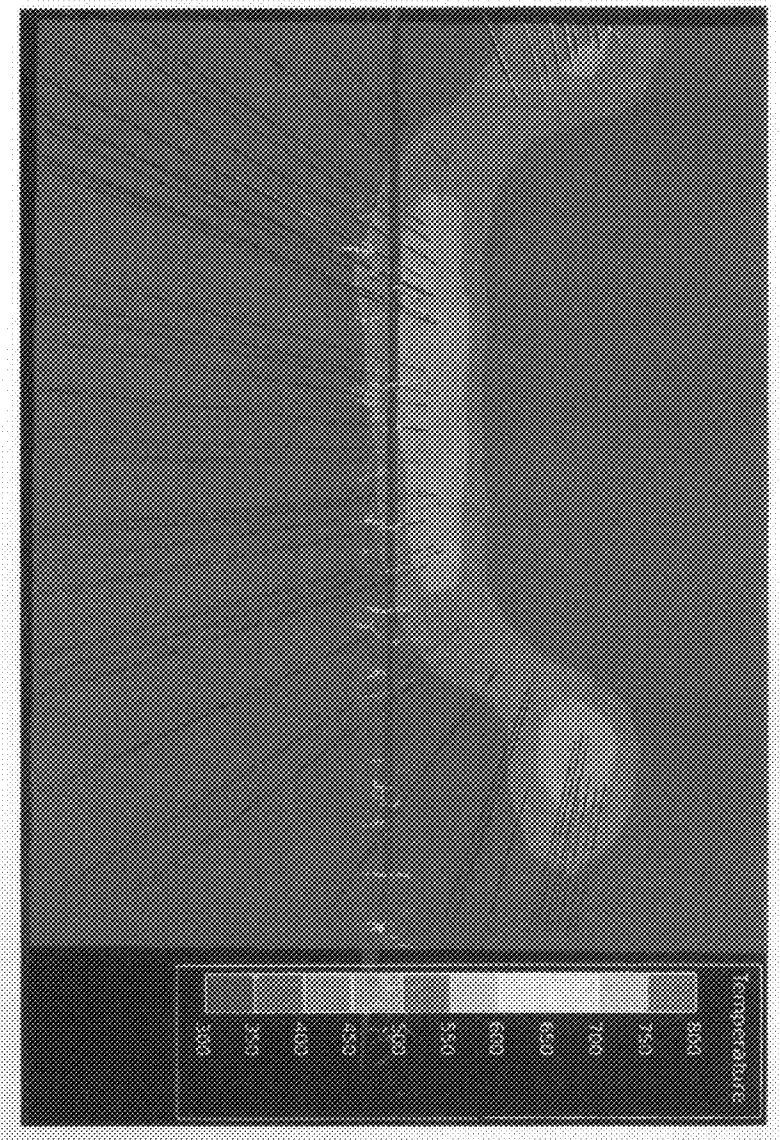
Figure 7A:
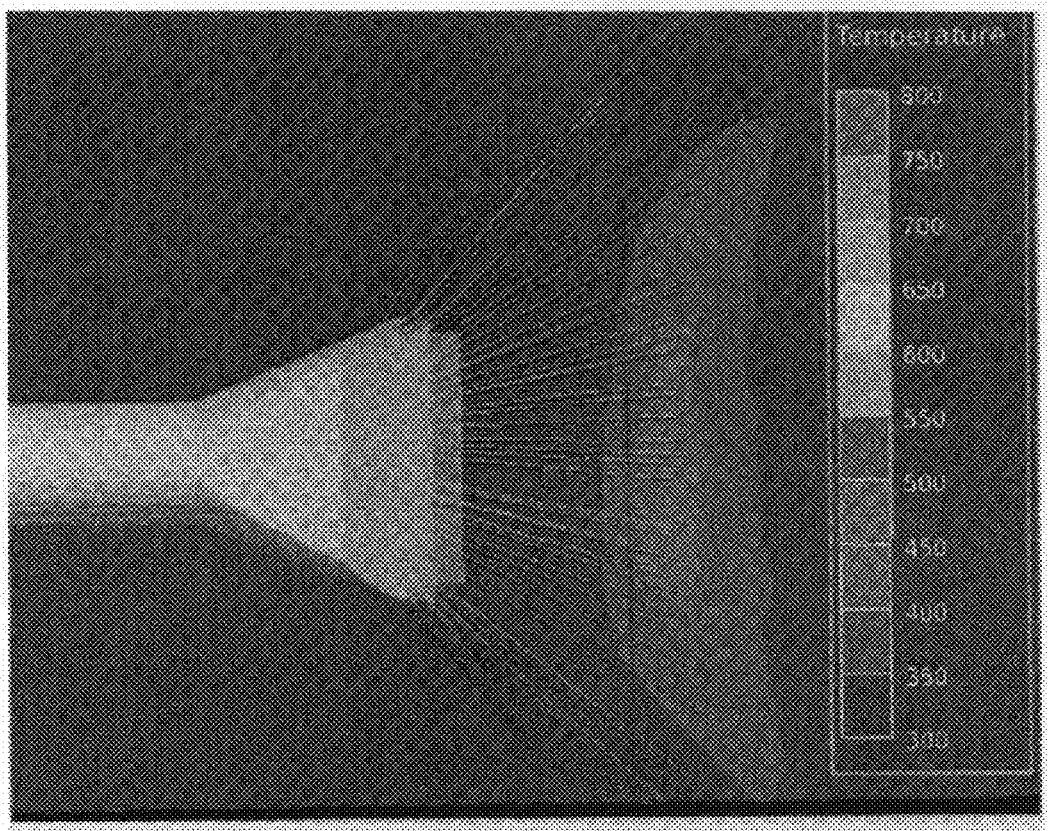

A computer generated diffuser model, exemplary of diffuser 10 illustrated and described above, was tested using a computational fluid dynamics (CFD) approach to simulate the exhaust temperatures at various planes away from the exhaust outlet of the diffuser. The results and testing conditions of the computer simulated tests are shown in FIGS. 5-7. For example, as shown in FIG. 5, the temperature of the exhaust entering the diffuser from the exhaust system of the vehicle was set at 1050° F. and the temperature of the exhaust just prior to exiting through the exhaust outlet opening was between approximately 910° F. and 980° F. Accordingly, the diffusion and expansion of the exhaust gas in the diffusion section 34 facilitates between an approximately 70° F. and 140° F. reduction of the exhaust gas temperature.

Referring now to FIG. 6, the maximum temperature of the exhaust on a horizontal plane six inches below the exhaust outlet opening was between approximately 400° F. and 450° F. Further, with reference to FIG. 7, the maximum temperature of the exhaust on a vertical plane six inches in front of the outlet opening was also between approximately 400° F. and 450° F. Accordingly, the maximum temperature of the exhaust at horizontal and vertical planes six inches away from the exhaust outlet opening of the tested diffuser had been reduced between approximately 600° F. and 650° F., which is between an approximately 38% and 43% reduction in temperature.

Exemplary Mounting Approaches

The diffuser can be mounted to a vehicle or equipment in a variety of orientations. For example, as shown in FIG. 5, the diffuser can be mounted horizontally relative to the ground. In other implementations, the diffuser can be mounted vertically relative to the ground or any other angle relative to the ground. Also, the diffuser can be mounted in any of various orientations about its axis such that the exhaust outlet faces in any of a variety of directions.

The diffuser can be mounted to a vehicle or equipment at any of a variety of locations. For example, as shown in FIG. 1A, in some implementations, the diffuser can be disposed at a location approximately midway along the length of a vehicle and below the frame of the vehicle. It is also recognized that in some implementations, the diffuser can be disposed above the frame of the vehicle and can be proximate the top of the vehicle. The diffuser can be mounted at an inboard location, e.g., mounted to an interior portion of the vehicle, or at an outboard location, e.g., mounted to an exterior portion of the vehicle. Also, the diffuser need not be positioned midway along the length of a vehicle, but can be disposed proximate, or anywhere between, the front or rear portions of the vehicle.

The diffuser can be mounted in a first orientation with a longitudinal axis that is horizontal and the exhaust gas outlet directed downwardly but mounting in this orientation is not required. The relational phrase "when mounted in a first orientation" can be used to describe relative positions of the elements in desirable embodiments and covers the same relative positions of the identified elements when the orientation is other than in the first orientation.

In view of the many possible embodiments to which the principles of the disclosed diffuser may be applied, it should be recognized that the illustrated embodiments are only preferred examples and should not be taken as limiting the scope of the disclosure.

The invention claimed is:

1. An exhaust diffuser for coupling to an exhaust system of a vehicle to diffuse exhaust gas from the exhaust system, the diffuser comprising:

an exhaust inlet portion comprising an exhaust gas inlet for coupling to the exhaust system to receive exhaust gas from the exhaust system;

an exhaust diffusion section in gas flow communication with the exhaust gas inlet section, the gas diffusion section comprising a top portion, a bottom portion, and first and second side portions when the diffuser is in a first orientation, the exhaust diffusion section lacking a plurality of baffles extending lengthwise along a substantial length of the diffusion section and extending from the top portion to the bottom portion, the first and second side portions at least in part comprising diverging side walls moving in a downstream direction away from the exhaust gas inlet so as to define a gas flow passageway that increases in cross-sectional dimension along at least a portion of the exhaust diffusion section in the downstream direction;

an exhaust deflector coupled to the exhaust diffusion section and positioned to direct the flow of exhaust gas traveling through the exhaust diffusion section in downward and laterally outward directions when the diffuser is in the first orientation, the exhaust deflector being sized to direct the flow of substantially all of the exhaust gas flowing through the exhaust diffusion section in downward and laterally outward directions when the diffuser is in the first orientation, the exhaust deflector comprising a deflector proximal end portion coupled to an upper portion of the exhaust diffusion section when the diffuser is in the first orientation and a deflector distal edge and first and second deflector side edges at respective sides of the deflector, the diffuser comprising a longitudinal axis with the exhaust deflector comprising a gas deflecting surface that is angled at an obtuse angle relative to a horizontal plane parallel to the longitudinal axis of the exhaust diffuser section, the exhaust diffuser section comprising a diffuser section lower edge at the downstream end of the bottom portion of the exhaust diffuser section, a first diffuser section side edge extending upwardly from the diffuser section lower edge at the downstream end of the first side portion and a second diffuser section side edge extending upwardly from the diffuser section lower edge at the downstream end of the second side portion when the diffuser is in the first orientation, a first lateral exhaust gas flow opening being provided between the first deflector side edge and the first diffuser section side edge, a second lateral exhaust gas flow opening being provided between the second deflector side edge and the second diffuser section side edge, and a lower gas flow opening being provided between the deflector distal edge and the diffuser section lower edge.

2. A diffuser according to claim 1 wherein the exhaust deflector comprises an exhaust deflection plate having an interior gas deflection surface, the interior gas deflection surface being parallel to the diffuser section lower edge and to a lower portion of the diffuser section first and second side edges.

3. An exhaust diffuser according to claim 1 wherein the exhaust deflector comprises an exhaust deflector plate having an interior gas deflection surface that is angled at an obtuse angle relative to a horizontal plane through the exhaust diffusion section when the diffuser is in the first orientation.

4. An exhaust diffuser according to claim 3 wherein the obtuse angle is from about 100 degrees to about 170 degrees.

5. An exhaust diffuser according to claim 4 wherein the obtuse angle is about 135 degrees.

6. An exhaust diffuser according to claim 1 having a single common passageway therethrough and wherein at least a portion of the single common passageway of the exhaust diffusion section is of an elongated ovular cross-section in a plane perpendicular to the downstream direction.

7. An exhaust diffuser according to claim 1 wherein at least a portion of exhaust diffusion section is of an elliptical cross-section.

8. An exhaust diffuser according to claim 7 wherein the exhaust diffusion section has a length and also comprises a passageway which is elliptical in cross-section with a major axis that increases in dimension moving in a downstream direction along at least a portion of the length of the diffusion section and a minor axis that is approximately constant along at least a portion of the length of the diffusion section.

9. A diffuser according to claim 1 having an approximately rectangular shaped side profile looking toward either the first or second side portions and an approximately triangular shaped footprint looking toward the bottom portion.

10. An exhaust diffuser according to claim 2 wherein the deflector distal edge is co-extensive with the diffuser section lower edge.

11. An exhaust diffuser according to claim 1 wherein the exhaust deflection plate terminates in an elongated straight edge at a location that is from a location that is no more than slightly above a horizontal plane containing the diffuser section lower edge and a location that is at or below the horizontal plane containing the diffuser section lower edge.

12. An exhaust diffuser according to claim 1 wherein the distance between the deflector distal edge and the diffusion section lower edge is about 20 mm.

13. An exhaust diffuser according to claim 1 wherein the exhaust diffuser is coupled to a tailpipe of a vehicle in the first orientation.

14. An exhaust diffuser according to claim 1 wherein the exhaust diffuser is coupled to the tailpipe of a vehicle in an orientation other than the first orientation.

15. An exhaust diffuser for coupling to an exhaust system of a vehicle to diffuse exhaust gas from the exhaust system, the diffuser comprising:

a body that, when in a first orientation, comprises top, bottom and first and second side portions;

the body comprising an exhaust gas inlet for coupling to the exhaust system of the vehicle and an exhaust gas outlet such that exhaust gas entering the exhaust gas inlet flows in a downstream direction through an exhaust gas passageway defined by the body from an upstream location at the exhaust gas outlet to the exhaust gas outlet at a downstream location;

the body comprising an exhaust diffusion section intermediate the exhaust gas inlet and the exhaust gas outlet, the cross-sectional area of the exhaust gas passageway increasing along at least a portion of the exhaust diffusion section moving in the downstream direction;

the body comprising an exhaust deflection portion positioned downstream of the exhaust diffusion section and angled downwardly when the body is in the first orientation, the exhaust deflection portion comprising an upper end portion and a lower end portion; and the exhaust opening comprising a slot of a substantially uniform width through the bottom portion and through at least a lower portion of each of the first and second side portions, the slot being at an upstream location relative to the exhaust deflection portion, whereby exhaust gas passes laterally through the first and second side portions and downwardly through the bottom portion when the body is in the first orientation.

16. An exhaust diffuser according to claim 15 wherein the slot is about 20 mm wide.

17. An exhaust diffuser according to claim 15 wherein the exhaust deflection portion composes a deflector plate portion.

18. An exhaust diffuser for diffusing exhaust gas from an exhaust system of a vehicle comprising:

a body comprising an exhaust gas inlet end portion comprising an exhaust gas inlet and an exhaust gas outlet end portion, comprising an exhaust gas outlet, the body also comprising top, bottom and first and second side portions when the body is in a first orientation;

the body comprising a generally rectangular profile looking toward the first side portion and the bottom portion comprising a generally triangular footprint; and the exhaust gas outlet being sized and shaped to provide substantially uniform gas flow in lateral and downward directions from the body when the body is in the first orientation.

19. An exhaust diffuser according to claim 18 wherein the gas inlet end portion is circular in cross section with a diameter, the exhaust diffuser comprising an exhaust diffusion section that has a length and also comprises a single common passageway which is elliptical in cross-section with a major axis that increases in dimension moving in a downstream direction along at least a portion of the length of the diffusion section and a minor axis that is approximately constant along the length of the diffusion section, the exhaust diffusion section being positioned intermediate to the exhaust gas inlet end portion and the exhaust gas outlet end portion, the exhaust diffusion section having a passageway with a height that is greater than or equal to the diameter.

20. An exhaust diffuser according to claim 18 wherein the exhaust gas outlet is a slot having a width that is substantially constant from side to side of the body and along at least a portion of each side of the body.

* * * * *

UNITED STATES PATENT AND TRADEMARK OFFICE

CERTIFICATE OF CORRECTION

PATENT NO. : 7,604,093 B2
APPLICATION NO. : 11/981245
DATED : October 20, 2009
INVENTOR(S) : Travis Bach It is certified that error appears in the above-identified patent and that said Letters Patent is hereby corrected as shown below:

Column 4, line 7, "angle θ" should read -- angle β --

Column 4, line 66, "IC" should read -- 1C --

Signed and Sealed this

Tenth Day of August, 2010

David J. Kappos

David J. Kappos
*Director of the United States Patent and Trademark Office*